US008785099B2

(12) United States Patent
Shu et al.

(10) Patent No.: US 8,785,099 B2
(45) Date of Patent: Jul. 22, 2014

(54) TONER, DEVELOPER INCLUDING THE TONER, AND DEVELOPING DEVICE AND IMAGE FORMING APPARATUS USING THE TONER

(75) Inventors: Hyo Shu, Mishima (JP); Mitsuo Aoki, Numazu (JP); Minoru Masuda, Numazu (JP); Kumi Hasegawa, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 47 days.

(21) Appl. No.: 13/177,203

(22) Filed: Jul. 6, 2011

(65) Prior Publication Data

US 2011/0268474 A1 Nov. 3, 2011

Related U.S. Application Data

(63) Continuation of application No. 11/079,194, filed on Mar. 15, 2005, now abandoned.

(30) Foreign Application Priority Data

Mar. 18, 2004 (JP) ..... 2004-077521
Mar. 18, 2004 (JP) ..... 2004-077522

(51) Int. Cl.
*G03G 9/087* (2006.01)

(52) U.S. Cl.
USPC ..... 430/109.4; 430/108.1; 430/108.6; 430/108.7

(58) Field of Classification Search
USPC ..... 430/109.4, 108.1, 108.6, 108.7
See application file for complete search history.

(56) References Cited

U.S. PATENT DOCUMENTS

| | | | | |
|---|---|---|---|---|
| 4,954,411 | A | 9/1990 | Nishibayashi et al. | |
| 5,061,588 | A | 10/1991 | Fushimi et al. | |
| 5,232,806 | A | 8/1993 | Yamada et al. | |
| 5,380,616 | A | 1/1995 | Aoki et al. | |
| 5,424,161 | A | 6/1995 | Hayashi et al. | |
| 5,747,210 | A | 5/1998 | Emoto et al. | |
| 6,117,607 | A | 9/2000 | Shimizu et al. | |
| 6,168,894 | B1 | 1/2001 | Aoki et al. | |
| 6,221,549 | B1 | 4/2001 | Emoto et al. | |
| 6,232,027 | B1 | 5/2001 | Matsunaga et al. | |
| 6,303,257 | B1 | 10/2001 | Hasegawa et al. | |
| 6,335,139 | B1 | 1/2002 | Gambayashi et al. | |
| 6,403,275 | B1 | 6/2002 | Kuramoto et al. | |
| 6,667,141 | B2 | 12/2003 | Iwamoto et al. | |
| 2002/0022188 | A1 | 2/2002 | Hashimoto et al. | |
| 2002/0155366 | A1 | 10/2002 | Mochizuki et al. | |
| 2003/0077533 | A1 | 4/2003 | Murota et al. | |
| 2003/0109668 | A1 | 6/2003 | Kubo et al. | |
| 2003/0129515 | A1 * | 7/2003 | Yamazaki et al. | 430/108.7 |
| 2003/0152859 | A1 | 8/2003 | Emoto et al. | |
| 2003/0165760 | A1 | 9/2003 | Higuchi et al. | |
| 2003/0190545 | A1 | 10/2003 | Daimon et al. | |
| 2004/0043315 | A1 | 3/2004 | Takiguchi et al. | |
| 2004/0067189 | A1 * | 4/2004 | Sugiura et al. | 423/335 |
| 2004/0067428 | A1 | 4/2004 | Itami | |
| 2004/0072091 | A1 | 4/2004 | Mochizuki et al. | |
| 2004/0138358 | A1 * | 7/2004 | Koch et al. | 524/297 |
| 2004/0142266 | A1 | 7/2004 | Sacripante et al. | |
| 2004/0191666 | A1 | 9/2004 | Kamada et al. | |
| 2004/0229145 | A1 | 11/2004 | Lee et al. | |
| 2004/0234878 | A1 | 11/2004 | Miyazaki et al. | |
| 2004/0265015 | A1 | 12/2004 | Koike et al. | |

FOREIGN PATENT DOCUMENTS

| | | | |
|---|---|---|---|
| EP | 0 479 285 | | 4/1992 |
| EP | 0 606 873 | A1 | 7/1994 |
| EP | 0 627 668 | A1 | 12/1994 |
| EP | 1 387 225 | A1 | 2/2004 |
| JP | 6-3853 | | 1/1994 |
| JP | 8-292598 | | 11/1996 |
| JP | 9-62031 | | 3/1997 |
| JP | 9-104741 | | 4/1997 |
| JP | 10-207112 | | 8/1998 |
| JP | 2000-221783 | | 8/2000 |
| JP | 2001-66820 | | 3/2001 |
| JP | 2001-215756 | | 8/2001 |
| JP | 2001-281911 | | 10/2001 |
| JP | 2001-305788 | | 11/2001 |
| JP | 2002-236384 | | 8/2002 |
| JP | 2003186250 | A * | 7/2003 |
| JP | 2003-231744 | | 8/2003 |
| JP | 2004-45668 | | 2/2004 |
| JP | 2004-326075 | | 11/2004 |

OTHER PUBLICATIONS

English language machine translation of JP 2003-186250 (Jul. 2003).*
Submission of published documents for Japanese patent application 2005-70404, Oct. 7, 2008.

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

A toner including toner particles including a binder resin containing at least one polyester resin comprising an inorganic tin (II) compound and an external additive including a particulate inorganic material having a volume average particle diameter greater than 70 nm and less than 300 nm. The binder resin preferably includes a polyester resin having a weight average molecular weight of from 5,000 to 50,000 and another resin having a weight average molecular weight of from 200,000 to 400,000. A developer including the toner; and a developing device, an image forming apparatus and a process cartridge, which form toner images using the toner are also provided.

14 Claims, 3 Drawing Sheets

TONER, DEVELOPER INCLUDING THE TONER, AND DEVELOPING DEVICE AND IMAGE FORMING APPARATUS USING THE TONER

CROSS REFERENCE TO RELATED APPLICATIONS

This application is a continuation application of U.S. application Ser. No. 11/079,194, filed Mar. 15, 2005 now abandoned, the disclosure of which is incorporated herein by reference in its entirety. The parent application claims priority to Japanese Application Nos. 2004-077522 and 2004-077521, both filed Mar. 18, 2004, the disclosures of which are incorporated herein by reference in their entireties.

BACKGROUND OF THE INVENTION

1. Field of the Invention

The present invention relates to a toner for use in developing an electrostatic latent image formed by a method such as electrophotography, electrostatic recording and electrostatic printing. In addition, the present invention also relates to a developer including the toner, and a developing device and an image forming apparatus using the toner.

2. Discussion of the Background

Electrophotographic image forming methods typically include the following steps:

(1) charging the surface of image bearing member such as photoreceptors with a charger utilizing discharging (charging step)

(2) irradiating the charged surface of the image bearing member with imagewise light to form an electrostatic latent image on the surface of the image bearing member (light irradiating step);

(3) developing the electrostatic latent image with a developer including a toner to form a toner image on the image bearing member (developing step);

(4) transferring the toner image to a receiving material optionally via an intermediate transfer medium (transferring step); and (5) fixing the toner image to the receiving material (fixing step).

In the fixing step, heat roller fixing methods in which a receiving material bearing a toner image thereon is sandwiched and fed by a pair of rollers including a heat roller are typically used because of having high energy efficiency. Recently, in view of environmental protection, a need exists for an image forming apparatus in which the energy consumption is minimized as much as possible. Therefore, it is necessary to reduce the heat capacity of the fixing members such as heat rollers and to develop a toner having good low temperature fixability.

However, toner having good low temperature fixability typically has a narrow fixable temperature range (i.e., poor hot offset resistance) and poor high temperature preservability. In attempting to remedy the drawbacks, published unexamined Japanese patent application No. (hereinafter referred to as JP-A) 2001-305788 discloses a toner including plural binder resins having different molecular weights. Namely, the toner includes a resin having a relatively low molecular weight which is used to impart good low temperature fixability to the toner, and another resin having a relatively high molecular weight which is used to impart a good combination of hot offset resistance and high temperature preservability to the toner.

Polyester resins are typically used for imparting good low temperature fixability to toner. In conventional methods for producing polyester resins, organic tin (IV) compounds such as dibutyl tin oxide, titanium compounds such as tetra-n-butyltitanate, germanium compounds such as germanium oxide, manganese compounds such as manganese oxide, etc., have been used as catalysts. For example, it is described in JP-A 2001-305788 to use a polyester resin which is prepared using an organic tin (IV) compound as a catalyst. However, organic tin (IV) compounds, which have a Sn—C bond, are considered to be an endocrine disrupter. Therefore, it is not preferable to use-such organic tin (IV) compounds.

JP-A 2003-231744 discloses a toner including a polyester resin which is prepared using an inorganic tin (II) compound as a catalyst. It is described therein that by using such a polyester resin, the resultant toner has good charge rising property. However, JP-A 2003-231744 is silent on the low temperature fixability, hot offset resistance and high temperature preservability of the toner. As a result of the present inventors' experiment, it is found that the toner has drawbacks in that toner particles tend to agglomerate when environmental conditions (such as temperature and humidity) change and/or the toner particles receive a mechanical stress (for example, by being agitated in a developing device), resulting in formation of an undesired image in which agglomerated toner particles adhere to toner image portions and/or background portions of toner images (this problem is hereinafter referred to as agglomeration problem).

In order to prevent toner particle from agglomerating, JP-A 10-207112 (i.e., Japanese Patent No. 3407580) discloses a toner which includes, as external additives, a hydrophobized particulate inorganic material A having a number average particle diameter of from 5 to 70 nm and a particulate inorganic material B having a number average particle diameter of from 80 to 800 nm and including particles having a particle diameter not less than 1000 nm in an amount not greater than 20% by quantity. It is described in the publication that the particulate material A improves the fluidity of the toner and the particulate material B prevents the toner particles from adhering to the surface of the photoreceptor used.

Because of these reasons, a need exists for a toner which includes a polyester resin prepared using a safe material (an inorganic tin compound) as a catalyst and which can produce toner images without causing the agglomeration problem.

SUMMARY OF THE INVENTION

Accordingly, an object of the present invention is to provide a toner and a developer which have a good combination of low temperature fixability, hot offset resistance and high temperature preservability and which can produce toner images without causing the agglomeration problem.

Another object of the present invention is to provide a developing device and an image forming apparatus which can produce images with relatively low fixing energy without causing the agglomeration problem.

Briefly these objects and other objects of the present invention as hereinafter will become more readily apparent can be attained by a toner including toner particles including, as a binder resin, a polyester resin including an inorganic tin (II) compound which is used as a catalyst when preparing the polyester resin, and a particulate inorganic material having a volume average particle diameter greater than 70 nm and less than 300 nm as an external additive.

It is preferable that the particulate inorganic material includes particles which do not pass through a sieve having openings of 45 μm in an amount not greater than 0.16% by weight. The content of the particulate inorganic material in the toner is from 0.4 to 4.0 parts by weight per 100 parts by weight of the toner.

It is preferable that the toner includes toner particles having a particle diameter not greater than 4 μm in an amount not greater than 10% by quantity.

The binder resin preferably include a resin A having a weight average molecular weight of from 5,000 to 50,000 and a resin B having a weight average molecular weight of from 200,000 to 400,000, wherein the resin A is the polyester resin mentioned above. The resin B is preferably a polyester resin which includes an inorganic tin (II) compound which is used as a catalyst when preparing the polyester resin.

The content of the resin A in the toner is preferably from 40 to 75% by weight based on the total weight of the binder resin.

It is preferable that the binder resin includes tetrahydrofuran (THF)-soluble components having a weight average molecular weight not greater than 1,000 in an amount of from 0.5 to 10% by weight based on the total weight of THF-soluble components of the binder resin.

It is preferable that the toner particles further include a wax. The content of the wax in the toner is preferably from 1 to 8 parts by weight per 100 parts by weight of the toner particles. It is preferable that the ratio (W/R) of the peak (W) of the wax observed in the vicinity of 3000 $cm^{-1}$ of a FTIR-ATR spectrum to the peak (R) of the binder resin in the vicinity of 830 $cm^{-1}$ thereof is from 0.05 to 0.20. The wax preferably has a melting point of from 60 to 100° C.

It is preferable that the toner further includes a lubricant to improve the cleanability of the toner and to prevent occurrence of a filming problem in that the toner adheres to the surface of the photoreceptor.

The content of the lubricant in the toner is preferably from 0.01 to 1.0 part by weight, and more preferably from 0.05 to 0.5 parts by weight, per 100 parts by weight of the toner particles.

It is preferable that the toner has a viscosity of from 80 to 3500 Pa·s in a temperature range of from 130 to 180° C., and a ratio (tan δ=G"/G') of the loss modulus (G") to storage modulus (G') of from 1.0 to 4.0.

As another aspect of the present invention, a developer is provided which includes a magnetic carrier and the toner mentioned above. The toner mentioned above can be used as a one component developer.

As yet another aspect of the present invention, a developing device is provided which includes a developer bearing member configured to bear the developer mentioned above to develop an electrostatic latent image on an image bearing member with the developer (one component developer or two component developer) to form a toner image; and a voltage applying member configured to apply a voltage (DC, AC or combination thereof) to form an electric field at a developing point in which the developer bearing member faces the image bearing member.

As a further aspect of the present invention, an image forming apparatus is provided which includes:

an image bearing member;

a charger configured to charge a surface of the image bearing member;

a light irradiator configured to irradiate the charged image bearing member with imagewise light to form an electrostatic latent image on the image bearing member;

a developing device configured to develop the electrostatic latent image with the developer mentioned above (one component developer or two component developer) to form a toner image on the image bearing member;

a transfer device configured to transfer the toner image onto a receiving material optionally via an intermediate transfer medium; and a fixing device configured to fix the toner image on the receiving material.

As a still further aspect of the present invention, a process cartridge is provided which includes an image bearing member configured to bear an electrostatic latent image and a developing device configured to develop the electrostatic latent image with the developer mentioned above to form a toner image on the image bearing member and which can detachably set in an image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
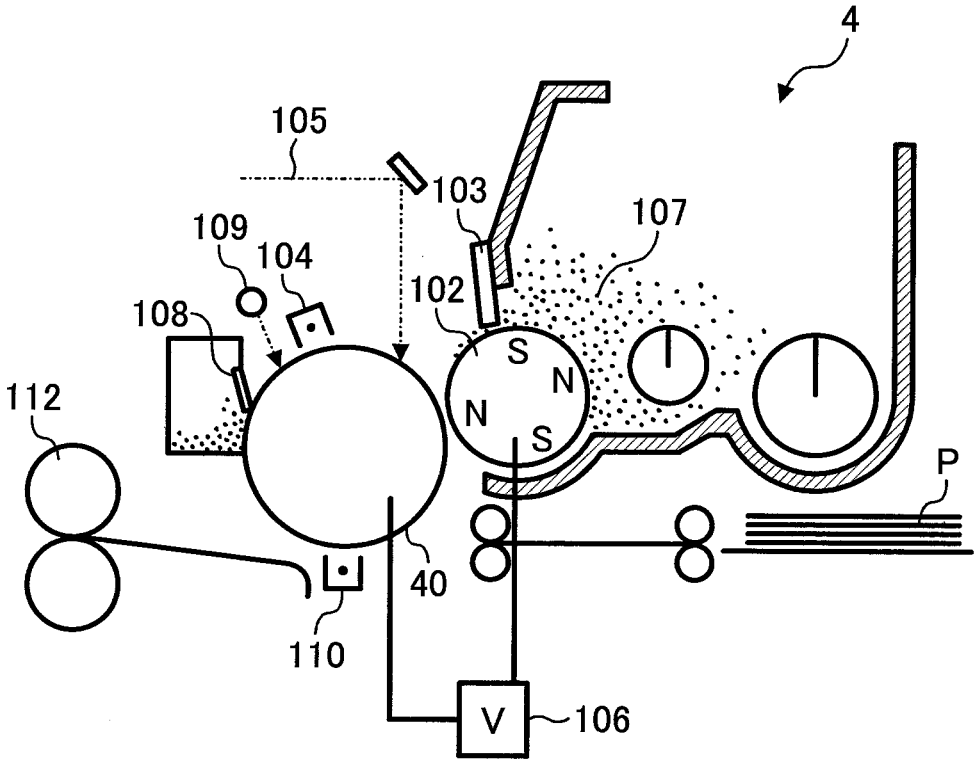
FIG. 1 is a schematic view illustrating an embodiment of the developing device of the present invention.

The toner of the present invention includes a polyester resin as a binder resin, which includes an inorganic tin (II) compound as a polymerization catalyst. It is preferable for the toner that the binder resin includes a resin component A having a weight average molecular weight of from 5,000 to 50,000 and a resin component B having a weight average molecular weight of from 200,000 to 400,000, wherein the resin component A is a polyester resin including an inorganic tin (II) compound as a polymerization catalyst. In addition, the toner preferably includes a particulate inorganic material having a volume average particle diameter greater than 70 nm and less than 300 nm as an external additive.

At first, the constituents of the toner of the present invention will be explained.

Polyester Resin

Polyester resins which are prepared using an inorganic tin (II) compound are used as a binder resin of the toner of the present invention.

Inorganic tin compounds mean tin compounds having no Sn—C bond therein. Specific examples of the inorganic tin compounds include tin (II) compounds having a carboxyl group such as tin (II) oxalate (i.e., stannous oxalate), tin (II) diacetate, tin (II) dioctanate, tin (II) dilaurate, tin (II) distearate, and tin (II) dioleate; tin (II) compounds having an alkoxy group such as dioctyloxy tin (II), dilauroxy tin (II), distearoxy tin (II), and dioleyloxy tin (II); tin (II) oxide; halogenated tin (II) such as stannous chloride and stannous bromide, etc. Among these compounds, tin (II) dioctanate, tin (II) distearate and tin (II) oxide are preferably used.

When polyester resins are prepared, polyhydric alcohols having two or more hydroxyl groups and polybasic carboxylic acids having two or more carboxyl groups are used as raw materials (i.e., monomers). In this regard, a small amount of monohydric alcohols and monobasic carboxylic acids can be used to control the molecular weight of the resultant polyester resin and to improve the offset resistance of the toner.

Specific examples of the dihydric alcohols include alkylene (carbon number of from 2 to 4) oxide (average molar number of from 1.5 to 6) adducts of bisphenol A such as polyoxypropylene (2.2)-2,2-bis(4-hydroxyphenyl)propane, and polyoxyethylene (2.2)-2,2-bis(4-hydroxyphenyl)propane; ethylene glycol, propylene glycol, neopentyl glycol, 1,4-butane diol, 1,3-butane diol, 1,6-hexane diol, etc.

Specific examples of the polyhydric alcohols having three or more carboxyl groups include sorbitol, pentaerythritol, glycerol, trimethylol propane, etc.

Specific examples of the dibasic carboxylic acids include aromatic dicarboxylic acids such as phthalic acid, terephthalic acid, and isophthalic acid; aliphatic dicarboxylic acids such as sebacic acid, fumaric acid, maleic acid, adipic acid, azelaic acid, and dodecenylsuccinic acid; alicyclic dicarboxylic acids such as cyclohexane dicarboxylic acid; and anhydrides of these acids and alkyl (carbon number of from 1 to 3) esters of these acids.

Specific examples of the polybasic carboxylic acids having three or more carboxyl groups include aromatic carboxylic acids such as 1,2,4-benzene tricarboxylic acid (i.e., trimellitic acid), 2,5,7-naphthalene tricarboxylic acid, and pyrromellitic acid; and anhydrides and alkyl (carbon number of from 1 to 3) esters of these acids.

Among these raw materials, secondary polyhydric alcohols and aromatic polybasic acids are preferably used. Secondary polyhydric alcohols mean polyhydric alcohols in which at least one hydroxyl group is connected with a secondary carbon atom. Specific examples thereof include propylene oxide adducts of bisphenol A, propylene glycol, 1,3-butane diol, glycerol, etc. Among these compounds, propylene oxide adducts of bisphenol A are preferably used.

Among the aromatic polybasic carboxylic acids, terephthalic acid, isophthalic acid, phthalic acid and trimellitic acid are preferably used. More preferably, trimellitic acid is used.

When either a secondary alcohol compound or an aromatic carboxylic compound is used, the content of the secondary alcohol compound or the aromatic carboxylic compound in the raw materials is preferably from 50 to 100% by mole, and more preferably from 80 to 100% by mole, based on the total moles of the alcohol monomers or the acid monomers. When both a secondary alcohol compound and an aromatic carboxylic compound are used, the content of the secondary alcohol compound and the aromatic carboxylic compound is preferably from 20 to 100% by mole, and more preferably from 50 to 100% by mole, based on the total moles of the raw monomers.

It is preferable to use either a secondary alcohol compound or an aromatic carboxylic compound and it is more preferable to use both a secondary alcohol compound or an aromatic carboxylic compound.

It is even more preferable to use a combination of a propylene oxide adduct of bisphenol A and terephthalic acid because the resultant toner has good charge stability due to the resonance effect of the benzene rings in the compounds. The same effect can be obtained when a mixture of a resin prepared using one of the compounds (i.e., a propylene oxide adduct of bisphenol A or terephthalic acid) and another resin prepared using another of the compounds is used as the binder resin.

Polyester resins, which can be used for the toner of the present invention, can be prepared by, for example, a method in which one or more of the alcohol components mentioned above and one or more of the carboxylic acids mentioned above are subjected to a condensation polymerization reaction in an inert gas atmosphere at a temperature of from 180 to 250° C., using an inorganic tin (II) compound as a catalyst. This reaction can be performed under a reduced pressure, if desired.

The added amount of a tin (II) compound is preferably from 0.001 to 5 parts by weight, and more preferably from 0.05 to 2 parts by weight, per 100 parts by weight of the monomers used. In addition, the content of a tin (II) compound in the polyester resin used for the toner is preferably from 0.001 to 5 parts by weight, and more preferably from 0.05 to 2 parts by weight, per 100 parts by weight of the resultant polyester resin.

Polyester resins having a softening point of from 90 to 170° C. and preferably 95 to 150° C. are preferably used as a binder resin for the toner for use in the image forming apparatus of the present invention. The glass transition temperature (Tg) of the polyester resins is preferably from 50 to 130° C., and more preferably from 50 to 80° C.

Binder Resin

The content of polyester resins in binder resins of the toner for use in the present invention is preferably from 50 to 100% by weight, more preferably from 80 to 100% by weight, and even more preferably 100% by weight.

Other resins such as addition polymerization resins (e.g., styrene-acrylic resins); epoxy resins, polycarbonate resins, and polyurethane resins can be used in combination with a polyester resin.

When one or more polyester resins are used in combination with one or more other resins, a mixture thereof can be used. However, it is preferable to use a hybrid resin in which two or more resins including a polyester resin are chemically bonded with each other. Namely, it is preferable to use a hybrid resin in which one or more polyester resins prepared using an inorganic tin (II) compound is partially bonded with one or more addition polymerization resin components. Hybrid resins can be prepared by the following methods:

(1) a method in which two or more resins are reacted;

(2) a method in which a resin is reacted with a mixture of monomers for another resin; and (3) a method in which monomers for two or more resins are reacted.

Among these methods, the method (3) is preferably used.

The binder resin of the toner for use in the image forming apparatus of the present invention preferably has a softening point of from 90 to 170° C. and more preferably from 95 to 150° C., and a glass transition temperature of from 50 to 130° C. and more preferably from 50 to 80° C.

The binder resin preferably includes a resin component A having a weight average molecular weight of from 5,000 to 50,000 and a resin component B having a weight average molecular weight of from 200,000 to 400,000, wherein at least one of the resin components A and B is a polyester resin including an inorganic tin (II) compound as a polymerization catalyst. By using such a binder resin for the toner of the present invention, the resultant toner has a good combination of low temperature fixability, hot offset resistance and high temperature preservability. When one or both of the resin components A and B have too high a weight average molecular weight, the resultant toner has poor low temperature fixability. In contrast, when one or both of the resin components A and B have too low a weight average molecular weight, the resultant toner has poor hot offset resistance and poor high temperature preservability. In addition, when the difference in weight molecular weight between the resin component B and resin component A is too large (i.e., the difference in viscosity between the resin component B and resin component A is too large), it is difficult to prepare a toner constituent mixture in which toner constituents are uniformly dispersed therein in the kneaded process.

When a polyester resin including an inorganic tin (II) compound as a polymerization catalyst is used as the resin component A, the resultant toner has a relatively good low temperature fixability compared to a toner in which a polyester resin including an organic tin (IV) compound is used as the resin component A. The reason therefor is considered to be as follows. When an inorganic tin (II) compound is used as a polymerization catalyst, the polymerization reaction proceeds at a relatively low speed compared to the case using an organic tin (IV) compound, and thereby the resultant polyester resin has a broad molecular weight distribution, i.e., has low molecular weight components in a relatively large amount.

It is preferable that the resin component B is also a polyester resin including an inorganic tin (II) compound as a polymerization catalyst. By using polyester resins each including an inorganic tin (II) compound as a polymerization catalyst as the binder resin of the toner of the present invention, the low temperature fixability of the toner can be further improved without deteriorating the hot offset resistance and high temperature preservability of the toner. In addition, inorganic tin compounds are harmless for human being, and therefore the resultant toner is improved in safety.

The content of the resin component A is preferably from 40 to 75% by weight, and more preferably from 45 to 65% by weight, based on the total weight of the binder resin. When the content of the resin component A is too low, the low temperature fixability of the toner deteriorates. In contrast, when the content is too high, problems in that the resultant toner images have too high glossiness, and the hot offset resistance and high temperature preservability of the toner deteriorate occur.

The weight average molecular weight of a resin can be determined by gel permeation chromatography (GPC).

In addition, the binder resin preferably includes tetrahydrofuran (THF)-soluble components having a molecular weight (Mw) not greater than 1000 in an amount of from 0.5 to 10% based on the total weight of the THF-soluble components included in the toner. When the content is too low, the resultant toner has a relatively high lowest fixable temperature. In contrast, when the content is too high, the toner tends to agglomerate, resulting in occurrence of the toner agglomeration problem.

Colorant

Known dye and pigments which can form yellow, magenta, cyan and black color toners can be used as the colorant of the toner for use in the image forming apparatus of the present invention.

Specific examples of the yellow colorants include Cadmium Yellow, Mineral Fast Yellow, Nickel Titan Yellow, naples yellow, NAPHTHOL YELLOW S (C.I. 10316), HANSA YELLOW G (C.I. 11680), HANSA YELLOW 10G (C.I. 11710), BENZIDINE YELLOW GR (C.I. 21100), QUINOLINE YELLOW LAKE, PERMANENT YELLOW NCG (C.I. 20040), Tartrazine Lake, etc.

Specific examples of the orange colorants include molybdenum orange, PERMANENT ORANGE GTR, PYRAZOLONE ORANGE, VULCANORANGE, INDANTHRENE BRILLIANT ORANGE RK, BENZIDINE ORANGE G, INDANTHRENE BRILLIANT ORANGE GK, etc.

Specific examples of the red colorants include red iron oxide, cadmium red, PERMANENT RED 4R, Lithol Red, PYRAZOLONE RED, calcium salts of WATCHUNG RED, LAKE RED D, BRILLIANT CARMINE 6B, Eosine Lake, Rhodamine Lake B, Alizarine Lake, BRILLIANT CARMINE 3B, etc.

Specific examples of the violet colorants include FAST VIOLET B, Methyl Violet Lake, etc.

Specific examples of the blue colorants include cobalt blue, Alkali Blue, VICTORIA BLUE LAKE, Phthalocyanine Blue, metal-free Phthalocyanine Blue, partially chlorinated Phthalocyanine Blue, Fast Sky Blue, INDANTHRENE BLUE BC, etc.

Specific examples of the green colorants include chrome green, chromium oxide, Pigment Green B, Malachite Green Lake, etc.

Specific examples of the black colorants include carbon black, oil furnace black, channel black, lamp black, acetylene black, azine dyes such as Aniline Black, metal salts of azo dyes, metal oxides, complex metal oxides, etc.

These dyes and pigments can be used alone or in combination.

Charge Controlling Agent

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and it compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON®, 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON®E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternaryammoniumsalt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

Wax

A wax is preferably included in the toner for use in the image forming apparatus of the present invention preferably includes a wax to impart good releasability thereto, i.e., to allow toner images to be easily released from fixing members of fixing devices. Since the toner includes a particulate inorganic material having an average particle diameter (D1) greater than 70 nm and less than 300 nm, which covers the surface of toner particles, a problem in that the wax included inside the toner particles exudes therefrom when the toner receives a stress in a developing device is not caused. Therefore, a filming problem in that a film of the toner (the wax in the toner) is formed on a photoreceptor or other image forming members is not caused.

Waxes having a melting point of from 60 to 100° C. are preferably used for the toner. This is because the waxes dispersed in binder resins can produce good releasing effects when the toner particles in a toner image are heated at an interface between the toner image and a fixing roller, and thereby a hot offset problem can be avoided even when a release agent such as oils is not applied to the fixing roller.

Suitable waxes for use in the toner include carnauba waxes, rice waxes and ester waxes. Carnauba waxes are a natural wax which can be obtained from leaves of carnauba palm trees. Among various carnauba waxes, carnauba waxes which are subjected to a free fatty acid elimination treatment and which have a low acid value are preferably used because of easily and uniformly dispersed in binder resins. Rice waxes are also a natural wax which are prepared by refining crude waxes produced in a de-waxing process or a wintering process when refining a rice bran oil extruded from rice bran. Ester waxes can be produced by subjecting a mono-functional linear fatty acid and a mono-functional linear alcohol to an ester reaction. Other waxes such as polyolefin waxes such as polyethylene waxes and polypropylene waxes can also be used. These waxes can be used alone or in combination.

The added amount of a wax in the toner is preferably from 1 to 8 parts by weight per 100 parts by weight of the binder resin included in the toner. When the added amount is too small, a good releasability cannot be imparted to the resultant toner. In contrast, when the added amount is too large, the high temperature preservability of the toner deteriorates, and the filming problem in that the wax adhered to a photoreceptor, resulting in formation of a wax film thereon tends to occur.

The toner can optionally include one or more additives such as fluidity improving agents and cleanability improving agents. Suitable materials for use as the fluidity improving agent include not only particulate inorganic materials having an average particle diameter in the above-mentioned range, but also particulate inorganic materials having an average particle diameter out of the above-mentioned range, and particulate polymers such as polystyrene, and (meth)acrylate copolymers, which are prepared by a polymerization method such as soap-free emulsion polymerization, suspension polymerization and dispersion polymerization, and particles of resins such as polycondensation polymers and thermosetting polymers.

Lubricant

It is preferable that the toner further includes a lubricant to improve the cleanability of the toner and to prevent occurrence of a filming problem in that the toner adheres to the surface of the photoreceptor. Specific examples of the lubricant include metal salts of fatty acids such as lead oleate, zinc oleate, copper oleate, zinc stearate, cobalt stearate, iron stearate, copper stearate, zinc palmitate, copper palmitate, and zinc linoleate. Among these materials, zinc stearate is preferably used. The lubricant is preferably added to mother toner particles which are prepared by melting/kneading toner constituents such as binder resins and colorants, andpulverizing the mixture after cooling.

When the toner includes a lubricant, the adhesion of toner particles to the surface of a photoreceptor can be decreased, and thereby toner particles remaining on the surface of a photoreceptor can be well removed with a cleaning blade. In addition, a filming problem in that the toner adheres to the surface of a photoreceptor (i.e., formation of a toner film on the surface) can be avoided.

The content of the lubricant in the toner is preferably from 0.01 to 1.0 part by weight, and more preferably from 0.05 to 0.5 parts by weight, per 100 parts by weight of the toner particles. When the content is too low, the above-mentioned effects cannot be produced. In contrast, when the content is too high, the low temperature fixability of the toner deteriorates.

Particulate Inorganic Material (External Additive)

The toner of the present invention include a particulate inorganic material, which has a volume average particle diameter ($D_1$) greater than 70 nm and less than 300 nm, and preferably greater than 70 nm and less than 200 nm, an external additive. When the volume average particle diameter is too small, the particulate material tends to be embedded into toner particles when receiving thermal and mechanical stresses. When the volume average particle diameter is too large, the particulate material cannot be uniformly dispersed on the surface of toner particles, and thereby the toner particles have uneven charge quantities, resulting in formation of background fouling in the resultant toner images.

Specific examples of the particulate inorganic materials include silica, titanium oxide, barium titanate, magnesium titanate, calcium titanate, strontium titanate, zinc oxide, tin oxide, quartz sand, clay, mica, sand lime, diatom earth, chromium oxide, cerium oxide, red iron oxide, antimony trioxide, magnesium oxide, zirconium oxide, barium oxide, barium carbonate, calcium carbonate, silicon carbide, silicon nitride, etc.

The particulate inorganic material is preferably subjected to a hydrophobizing treatment to prevent deterioration of the fluidity and charge properties of the resultant toner even under high humidity conditions.

Suitable hydrophobizing agents for use in the hydrophobizing treatment include known hydrophobizing agents such as silane coupling agents, silylation agents, silane coupling agents having a fluorinated alkyl group, organic titanate coupling agents, aluminum coupling agents, silicone oils, modified silicone oils, etc.

The particulate inorganic material preferably includes coarse particles, which do not pass through a sieve having openings of 45 μm, in an amount not greater than 0.16% by weight. When coarse particles are included in too large an amount, the inorganic material cannot be uniformly adhered to the surface of the toner particles, resulting in deterioration of fluidity of the toner.

The amount of coarse particles in a particulate inorganic material can be determined by the following method:

(1) a sieve having openings of 45 μm, which have been washed and dried, is precisely weighed on the order of 0.1 mg;

(2) about 10 g of a sample is contained in a glass container to be precisely weighed to determine the weight (Wt) of the toner sample on the order of 0.1 mg;

(3) 90 g of methanol are added to the toner sample, and the mixture is vibrated with a vibrator to disperse the toner in methanol;

(4) the dispersion is passed through the sieve, and then the sieve is dried for 1 hour at 105° C.; and (5) after being cooled, the sieve is precisely weighed to determined the weight difference (Wd) before and after the sieving operation (i.e., to determine the amount of coarse particles).

The content (C) of coarse particles in the particulate inorganic material can be determined by the following equation (1):

$$C(\%\text{ by weight})=(Wd/Wt)\times 100$$

The content of the particulate inorganic material in the toner is from 0.4 to 4.0 parts by weight, and preferably from 1.0 to 1.5 parts by weight, per 100 parts by weight of the toner. When the content is too low, the fluidity improving effect and agglomeration preventing effect cannot be produced, and thereby the image qualities of half tone images deteriorate and an omission problem in that the resultant toner images have omissions (white spots) occurs. In contrast, when the content is too high, the minimum fixable temperature of the toner increases (i.e., the low temperature fixability of the toner deteriorates).

Toner Preparation Method

The method for preparing the toner for use in the image forming apparatus of the present invention is not particularly limited, and kneading/pulverizing methods and polymerizing methods can be used. The kneading/pulverizing methods typically include the following steps:

(1) toner constituents such as binder resins, waxes, colorants, charge controlling agents and other additives are mixed with a mixer;

(2) the mixture is kneaded with a kneader such as heat rollers and extruders, followed by cooling;

(3) the kneaded mixture is pulverized with a pulverizer such as jet mills; and (4) the pulverized mixture is classified to prepare toner particles.

The thus prepared toner particles is then mixed with the particulate inorganic material mentioned above using a mixer such as SUPER MIXER and HENSCEL MIXER.

The thus prepared toner preferably has a weight average particle diameter (D4) of from 3 to 10 μm. When the average particle diameter is too small, a problem in that toner particles adhere to the surface of a magnetic carrier included in a two component developer when agitated in a developing device for a long period of time, resulting in deterioration of charging ability of the carrier. When such a toner is used as a one component developer, a problem in that the toner adheres to a developing roller or a blade used for forming a thin toner layer on a developing roller tends to occur. In contrast, when the weight average particle diameter is too large, high quality and high definition images cannot be produced. In addition, the particle diameter of the toner tends to vary when used in a developing device for a long period of time while a fresh toner is replenished.

It is preferable for the toner to include fine toner particles having a particle diameter not greater than 4 μm in an amount not greater than 10% by quantity. When the content is too high, the toner tends to cause the agglomeration problem. The content of fine toner particles can be controlled by controlling the classification conditions.

It is preferable that the toner of the present invention includes a wax in a surface portion of toner particles so that the wax can effectively produce the releasing effect thereof in a fixing process. Thereby an offset problem can be avoided.

The amount of a wax present in a surface portion can be determined by FTIR-ATR (Fourier Transform Infrared-Attenuated Total Reflection) spectroscopy. By using this method, the content of a wax present in a surface portion having a thickness of about 0.3 μm from the surface can be determined.

It is preferable for the toner that the ratio (W/R) of the height (W) of a peak of a wax in the vicinity of a wavelength of 3000 $cm^{-1}$ the height (R) of a peak of a resin in the vicinity of a wavelength of 830 $cm^{-1}$ is preferably from 0.05 to 0.20. When the ratio is too small (i.e., the content of the wax in the surface portion is too low), the offset problem tends to occur. In contrast, when the ratio is too large (i.e., the content of the wax in the surface portion is too high), the toner tends to cause the agglomeration problem. The content of a wax in the surface portion and the ratio (W/R) can be controlled by controlling the added mount of the wax and manufacturing conditions such as kneading conditions.

The toner for use in the image forming apparatus of the present invention preferably has the following properties:

(1) the melt viscosity thereof is from 80 to 3,500 Pa·s, and more preferably from 120 to 2,500 Pa·s, in a temperature range of from 130 to 180° C.; and (2) the ratio (tan δ=G"/G') of the loss modulus (G") of the toner to the storage modulus (G') thereof is from 1.0 to 4.0, and more preferably from 1.0 to 3.0, in a temperature range of from 130 to 180° C.

When the viscosity is too low, the toner tends to cause the agglomeration problem. In contrast, when the viscosity is to high, the low temperature fixability and glossiness of the toner images deteriorate. In this case, the difference in viscosity of the toner and the wax included therein increases, resulting occurrence of a problem in that the wax cannot be well dispersed in the toner and is separated from the toner particles.

When the ratio (tan δ) is in the range mentioned above, a problem in that the resultant toner images is uneven in glossiness can be avoided. In addition, the agglomeration problem can be avoided, and therefore high quality toner images can be produced.

The storage modulus (G') is an indexical property of the elasticity of toner. When a toner image formed of a toner including a large amount of elastic components is applied with heat energy, the elastic components expand and contract, and thereby the toner image scatters light, resulting in decrease of the glossiness.

In contrast, the loss modulus (G") is an indexical property of the viscosity of toner. Toner including a large amount of viscous components can be uniformly melted and thereby glossy toner images can be produced. However, the agglomeration problem tends to occur.

The present inventors discover that by controlling the ratio (tan δ) so as to be in the above-mentioned range, the resultant toner images have good glossiness and fixability without causing the agglomeration problem. When the ratio is too small (i.e., the storage modulus G' is too large), the glossiness of the resultant toner images deteriorate. When the ratio is too large, the toner tends to cause the agglomeration problem.

The toner of the present invention can be used as a one component developer by itself, and can be used for a two component developer by being combined with a magnetic carrier.

Known carriers for use in the conventional two component developers can be used for the developer of the present invention. Specific examples of the materials for use as the carrier include particles of magnetic materials such as iron and ferrites; resin-coated carriers in which particulate magnetic materials are covered with a resin; and particulate resin carriers in which a magnetic powder is dispersed in a particulate resin. Among these carriers, resin-coated carriers using a resin, such as silicone resins, copolymers (such as graft copolymers) of organopolysiloxanes and vinyl monomers, and polyester resins, for the covering resin can be preferably used because occurrence of a spent toner problem in that toner adheres to the surface of carrier particles, and thereby the charging ability of the carrier particles is deteriorated can be prevented. In addition, it is more preferable to use a carrier coated with a resin which is prepared by reacting a copolymer of organopolysiloxane and a vinyl monomer with an isocyanate, because the resultant carrier has good durability, good weather resistance and good resistance to the spent toner problem. In this case, it is necessary for the vinyl monomer to include a group reactive with an isocyanate, such as a hydroxyl group.

The magnetic carrier particles for use in the developer of the present invention preferably have a volume average particle diameter of from 20 to 100 μm, and more preferably from 20 to 60 μm to produce high quality images and to prevent a problem in that background of toner images has fouling due to the carrier particles.

Then the developing device of the present invention will be explained referring to FIG. 1.

FIG. 1 is a schematic view illustrating an embodiment of the developing device of the present invention. In FIG. 1, a developing device 4 includes a developing roller 102 configured to bear a toner 107 on the surface thereof and a blade 103 configured to form a thin layer of the toner 107. An electrostatic latent image formed on a photoreceptor 40, which is formed using a charger 104 and imagewise light 105, is developed with the toner 107 on the developing roller 102, thereby forming a toner image on the photoreceptor 40. In this case, a voltage is applied to the photoreceptor 40 and the developing roller 102 by a voltage applicator 106 to form an electric field at the developing position in which the developing roller 102 faces the photoreceptor 40.

The toner image formed on the photoreceptor 40 is transferred on a receiving paper P which is timely fed by pairs of rollers while a transfer device 110 applies a voltage to the receiving paper P. The toner image on the receiving paper P is then fixed with a fixing device 112. Toner particles remaining on the photoreceptor 40 even after the transfer process are removed from the surface of the photoreceptor 40 with a cleaner 108. Charges remaining on the surface of the photoreceptor are discharged with a discharger 109.

The image forming apparatus of the present invention will be explained referring to FIG. 2.

Figure 2:
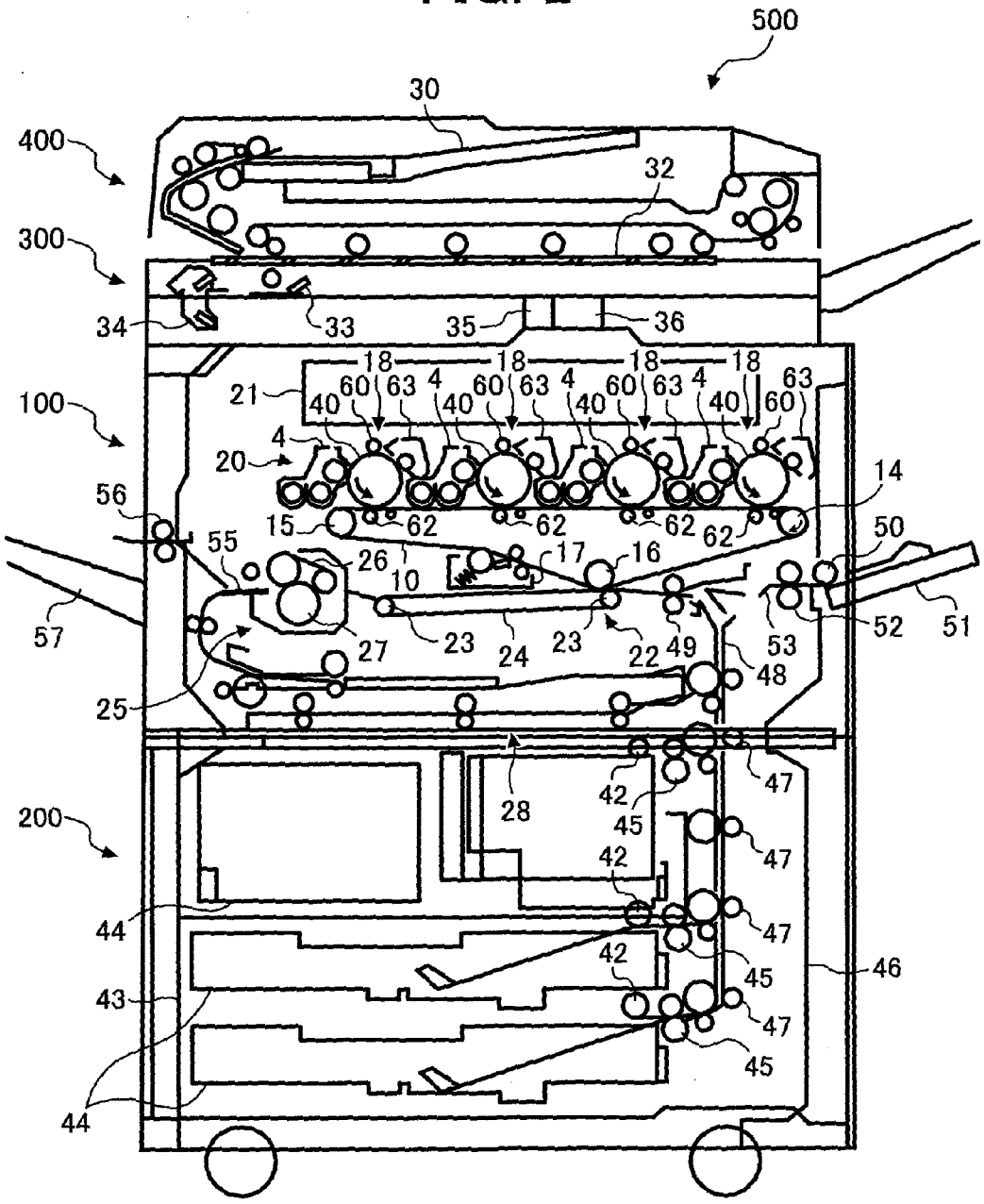
FIG. 2 is a schematic view illustrating an embodiment of the image forming apparatus of the present invention.

FIG. 2 is the overview of an embodiment of the image forming apparatus of the present invention, which is a tandem-type color image forming apparatus.

In FIG. 2, a tandem-type color image forming apparatus 500 includes an image forming section 100 (i.e., a main body of the image forming apparatus), a paper feeding section 200, a scanner 300 and an automatic document feeder 400.

The image forming section 100 includes an endless intermediate transfer medium 10 which is provided in the center of the image forming section 100. The intermediate transfer medium 10 is rotated in the clockwise direction by rollers 14, and 16 while tightly stretched by the rollers. A cleaner 17 is provided near the roller 16 to remove toner particles remaining on the surface of the intermediate transfer medium.

Four image forming units 18 for forming yellow, magenta, cyan and black toner images are arranged side by side on the intermediate transfer medium 10. The image forming units 18 include respective photoreceptors 40. Numeral 20 denotes a tandem type developing device. The developing device 20 includes four developing devices arranged in the respective four image forming units 18. A light irradiator 21 which irradiate the image bearing member with imagewise light to form an electrostatic latent image on the image bearing member is arranged at a location over the image forming units 18.

A second transfer device 22 is provided below the intermediate transfer medium 10. The second transfer device 22 includes an endless belt 24 which is rotatably stretched a pair of rollers 23. The endless belt 24 feeds a receiving material so that the toner images on the intermediate transfer medium 10 are transferred to the receiving material while sandwiched by the intermediate transfer medium 10 and the endless belt 24.

A fixing device 25 is arranged at a position near the second transfer device 22. As illustrated in FIG. 2, the fixing device 25 includes an endless fixing belt 26 and a pressing roller 27 which presses the fixing belt 26.

The second transfer device 22 also has a sheet feeding function of feeding recording paper sheets to the fixing device 25. It is also possible that the second transfer device 22 includes a transfer roller and a non-contact charger. In this case, the second transfer device cannot have a function of feeding recording paper sheets.

In addition, a sheet reversing device 28 configured to reverse the receiving material is provided at a position near the fixing device 25, to produce double-sided copies.

Each image forming device 18 includes a developing device 4 which contains the toner (developer) mentioned above. The developing device 4 includes a developer bearing member configured to bear and feed the toner to a position of the developer bearing member facing the photoreceptor 40. The developing device 4 develops an electrostatic latent image on the photoreceptor 40 with the developer while applying an alternate voltage. By applying an alternate voltage to the developer, the developer can be activated, and thereby the developer has a narrow charge quantity distribution, resulting in improvement of the developability of the developer.

A process cartridge including at least a photoreceptor and a developing device, which are integrated onto a unit and which can be detachably attached to the image forming apparatus, can also be used. The process cartridge can include other devices such as chargers and cleaners.

Then the full color image forming operation using the tandem-type color image forming apparatus 500 will be explained.

An original to be copied is set on an original table 30 of the automatic document feeder 400. Alternatively, the original is directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34 which move in the right direction. In the case where the original is set on the table 30 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black, yellow, magenta and cyan color image data) is provided.

The black, yellow, magenta and cyan color image data are sent to the respective black, yellow, magenta and cyan color image forming units 18, and black, yellow, magenta and cyan color toner images are formed on the respective photoreceptors 40. Each of the image forming units 18 includes a charger 60 configured to charge the image bearing member 40, the developing device 4, an image bearing member's cleaning device 63 configured to clean the surface of the image bearing member.

The thus prepared black, yellow, magenta and cyan color toner images are transferred one by one to the intermediate transfer medium 10 which is rotated by the rollers 14, 15 and 16, resulting in formation of a full color toner image on the intermediate transfer medium 10. Numeral 62 denotes a transfer charger.

On the other hand, one of paper feeding rollers 42 is selectively rotated to feed the top paper sheet of paper sheets stacked in a paper cassette 44 in a paper bank 43 while the paper sheet is separated one by one by a separation roller 45 when plural paper sheets are continuously fed. The paper sheet is fed to a passage 48 in the image forming section 100 through a passage 46 in the paper feeding section 200, and is stopped once by a pair of registration rollers 49. Numeral 47 denotes feed rollers. A paper sheet can also be fed from a manual paper tray 51 to a passage 53 by a feed roller 50 and a pair of separation rollers 52. The thus fed paper sheet is also stopped once by the registration roller 49. The registration rollers 49 are generally grounded, but a bias can be applied thereto to remove paper dust therefrom.

The thus prepared full color toner image on the intermediate transfer medium 10 is transferred to the paper sheet, which is timely fed by the registration roller 49, at the contact point of the second transfer device 22 and the intermediate transfer medium 10. Toner particles remaining on the surface of the intermediate transfer medium 10 even after the second image transfer operation are removed therefrom by the cleaner 17.

The paper sheet having the full color toner image thereon is then fed by the second transfer device 22 to the fixing device 25, and the toner image is fixed on the paper sheet upon application of heat and pressure. Then the paper sheet is discharged from the image forming section 100 by a pair of discharge rollers 56 while the path is properly selected by a paper path changing pick 55. Thus, a copy is stacked on a tray 57. When a double sided copy is produced, the paper sheet having a toner image on one side thereof is fed to the sheet reversing device 28 to be reversed. Then the paper sheet is fed to the second transfer device 24 so that an image is transferred to the other side of the paper sheet. The image is also fixed by the fixing device 25 and then the copy is discharged to the tray 57 by the discharge roller 56.

Figure 3:
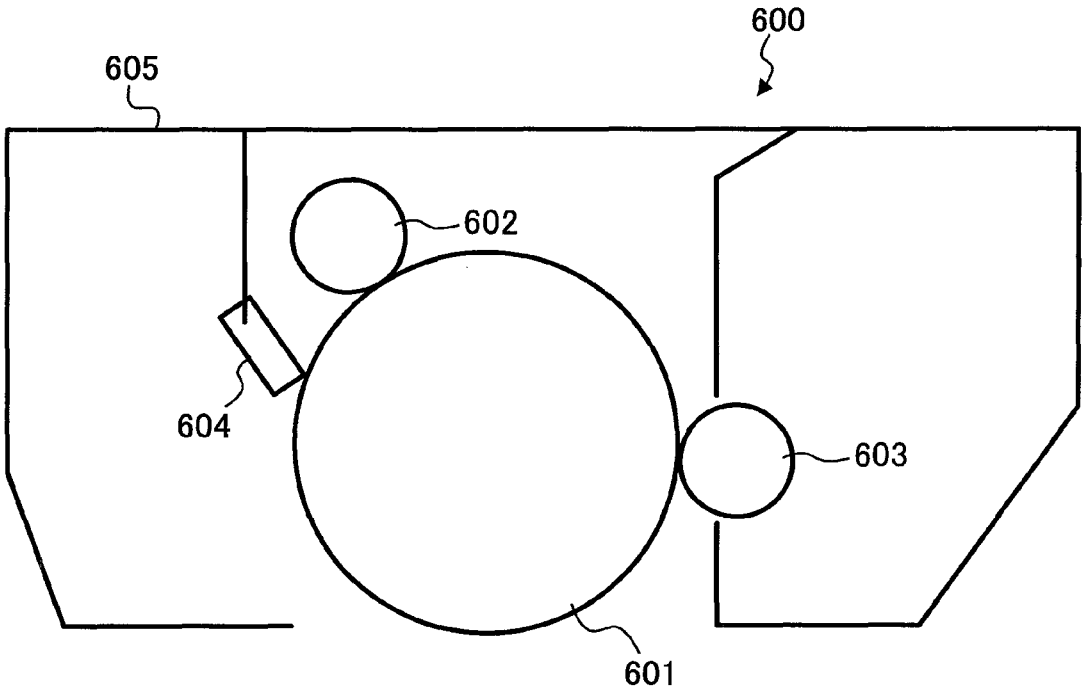
FIG. 3 is a schematic view illustrating an embodiment of the process cartridge of the present invention.

FIG. 3 is a schematic view illustrating an embodiment of the process cartridge of the present invention.

Numeral 600 denotes the process cartridge. The process cartridge 600 includes a photoreceptor 601, a charger 602, a developing device 603, a cleaner 604 and a housing 605. The process cartridge of the present invention includes at least an image bearing member (such as photoreceptors) bearing an electrostatic latent image and the developer of the present invention.

The process cartridge 600 can be detachably set in an image forming apparatus such as copiers and printers.

The image forming apparatus including such a process cartridge can perform image forming operations similar to those mentioned above (i.e., charging, irradiating, developing, transferring, fixing, cleaning, etc.).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Polyester Resin

The following components were contained in a four necked flask equipped with a thermometer, a stainless stirrer, a falling type condenser, and a nitrogen gas feeding pipe.

| | |
|---|---|
| Polyoxypropylene(2.2)-2,2-bis(4-hydroxyphenyl)-propane | 390 g |
| Isophthalic acid | 120 g |
| 1,2,5-benzenetricarboxylic acid | 38 g |
| Tin (II) dioctanate | 1 g |

After being heated to 220° C. using a mantle heater, the mixture was reacted under a nitrogen gas flow. When the resultant resin had a target glass transition temperature, the reaction was stopped. Thus, a polyester resin A was prepared. The polyester resin A included tetrahydrofuran-insoluble components in an amount of 3%, and had a weight average molecular weight of 36,000, an acid value of 10 mgKOH/g and a glass transition temperature of 65° C.

Preparation of Toner

The following components were mixed.

| | |
|---|---|
| Cyan pigment (PIGMENT BLUE 15-3, having a primary particle diameter of 90 nm) | 4 parts |
| Polyester resin A | 4 parts |
| Pure water | 2 parts |

The mixture was kneaded at 70° C. using a two roll mill. Then the temperature of the rollers was raised to 120° C. to evaporate water in the mixture. Thus, a colorant masterbatch was prepared.

The following components were mixed.

| | |
|---|---|
| The colorant masterbatch prepared above | 8 parts |
| Polyester resin A | 91 parts |
| Charge controlling agent (BONTRON E-84 from Orient Chemical Industries Co., Ltd.) | 2 parts |
| Carnauba wax | 5 parts |

The mixture was melted and kneaded for 40 minutes at 50° C. using a two-roll mill. After being cooled, the kneaded mixture was crushed with a hammer mill, followed by pulverizing with an air jet pulverizer and classification. Thus, a mother toner, which has a weight average particle diameter (D4) of 6.5 μm and includes fine particles having a particle diameter not greater than 4 μm in an amount of 12% by quantity, was prepared.

Then the following components were mixed using a mixer to prepare a toner.

| | |
|---|---|
| Mother toner prepared above | 106 parts |
| Hydrophobized silica | 0.3 parts |

(X-24 from Shin-Etsu Chemical Co., Ltd., average particle diameter of 80 nm and coarse particle amount of 0.18% by weight)

Thus, a toner of Example 1 was prepared. The properties of the toner are shown in Table 1.

Example 2

The procedure for preparation of the toner in Example 1 was repeated except that the hydrophobized silica was replaced with another hydrophobized silica having an average particle diameter of 280 nm and including coarse particles in an amount of 0.2% by weight.

Thus, a toner of Example 2 was prepared.

Example 3

The procedure for preparation of the toner in Example 2 was repeated except that the hydrophobized silica was replaced with another hydrophobized silica having an average particle diameter of 140 nm and including coarse particles in an amount of 0.1% by weight.

Thus, a toner of Example 3 was prepared.

Example 4

The procedure for preparation of the toner in Example 3 was repeated except that the added amount of the hydrophobized silica was changed from 0.3 to 1 part by weight.

Thus, a toner of Example 4 was prepared.

Example 5

The procedure for preparation of the toner in Example 4 was repeated except that the classification conditions (i.e., revolution of the classifier and the quantity of the powder fed into the classifier to be classified) were changed.

Thus, a toner of Example 5 was prepared.

Example 6

The procedure for preparation of the toner in Example 5 was repeated except that the added amount of the carnauba wax was changed from 5 to 4.5 parts by weight.

Thus, a toner of Example 6 was prepared.

Example 7

The procedure for preparation of the toner in Example 6 was repeated except that the polyester resin A was replaced with the following polyester resin B.

Polyester Resin B

The procedure for preparation of the polyester resin A was repeated while the target glass transition temperature was changed. The resultant polyester resin B included tetrahydrofuran-insoluble components in an amount of 5% by weight and had a weight average molecular weight of 42,000, an acid value of 15 mgKOH/g and a glass transition temperature (Tg) of 66° C.

Thus a toner of Example 7 was prepared.

Example 8

The procedure for preparation of the toner in Example 6 was repeated except that the polyester resin A was replaced with the following polyester resin C.

Polyester Resin C

The procedure for preparation of the polyester resin A was repeated while the target glass transition temperature was changed. The resultant polyester resin C included tetrahydrofuran-insoluble components in an amount of 5% by weight and had a weight average molecular weight of 39,000, an acid value of 12 mgKOH/g and a glass transition temperature (Tg) of 66° C.

Thus a toner of Example 8 was prepared.

Comparative Example 1

The procedure for preparation of the toner in Example 1 was repeated except that the hydrophobized silica was replaced with another hydrophobized silica having an average particle diameter of 70 nm.

Thus, a toner of Comparative Example 1 was prepared.

Comparative Example 2

The procedure for preparation of the toner in Example 2 was repeated except that the hydrophobized silica was replaced with another hydrophobized silica having an average particle diameter of 300 nm.

Thus, a toner of Comparative Example 2 was prepared.

The physical properties of the particulate inorganic materials, the binder resins and the toners of Examples 1 to 8 and Comparative Examples 1 and 2 were evaluated as follows.

1. Average Particle Diameter of Particulate Inorganic Material

The measurement method is as follows.

(1) 0.1 g of a sample is contained in a glass container, and 20 g of methanol are added thereto;

(2) the mixture is subjected to a dispersion treatment for 10 minutes using an ultrasonic dispersion machine to prepare a dispersion of the sample;

(3) the particle diameter distribution of the dispersion is measured using a laser scattering particle size distribution analyzer to determine the median diameter of the sample.

Content of Coarse Particles in Particulate Inorganic Material

The method for determining the content of coarse particles in a particulate inorganic material is mentioned above.

Weight Average Particle Diameter (D4)

One hundred (100) to 150 milliliters of an electrolyte are mixed with 0.1 to 5 ml of a surfactant (alkylbenzene sulfonate). Then 2 to 20 mg of a sample are added to the electrolyte, and the mixture is subjected to a dispersion treatment for 1 to 3 minutes using an ultrasonic dispersing machine. The particle diameter distribution of the sample on volume basis in the range of from 2 to 40 μm is determined using an instrument COULTER COUNTER IIe from Beckmann Coulter and an aperture of 100 μm.

Content of Fine Toner Particles

The method for determining the content of fine particles in a toner is determined by the method described in JP-A08-136439, incorporated herein by reference. The procedure is as follows:

(1) a 1% aqueous solution of sodium chloride is prepared using a first class NaCl, and the solution is passed through a filter having openings of 0.45 μm;

(2) 50 to 100 ml of the filtered NaCl solution is mixed with 0.1 to 5 ml of a surfactant (alkylbenzene sulfonate), and 1 to 10 mg of a sample are added thereto;

(3) the sample mixture is subjected to a dispersion treatment using an ultrasonic dispersing machine to prepare a dispersion in which particles of the sample are present at a concentration of from 5,000 to 15,000 pieces/μl;

(4) the number of particles having a circle-equivalent particle diameter not less than 0.6 μm (which is determined in view of precision of the CCD camera used) is determined using a flow type particle image analyzer FPIA-1000 from Sysmex Corp., to determine the percentage of fine particles, which have a particle diameter not greater than 4 μm, in the sample.

Content of Wax in Surface Portion of Toner Particles

The content of a wax in a surface portion of toner particles can be determined by FTIR-ATR spectroscopy. Specifically, the ratio (W/R) of the height (W) of a peak specific to the wax to the height (R) of a peak specific to the binder resin is determined. The procedure is as follows.

(1) 0.6 g of a toner sample is pressed for 30 seconds at a load of 6 tons using an automatic pellet forming machine (TYPE M No. 50 BRP-E from Maekawa Testing Machine Co.) to prepare a pellet of the toner having a thickness of about 2 mm; and (2) the pellet is set in an instrument, i.e., a combination of SPECTRUM ONE with a MULTISCOPE FTIR unit from Perkin Elmer, to be subjected to a FTIR-ATR (micro ATR) spectroscopic analysis using a germanium crystal having a diameter of 100 μm.

The measuring conditions are as follows.

Incident angle of infrared light: 41.5°

Resolution: 4 $cm^{-1}$

Accumulation: 20 times

Thus, the ratio (W/R) of the height (W) of a peak (2918 $cm^{-1}$) specific to the wax to the height (R) of a peak specific to a resin (for example, 829 $cm^{-1}$ for a polyester resin and 697 $cm^{-1}$ for a styrene-acrylic resin) is determined. When both a polyester resin and a styrene-acrylic resin are included in the toner, the heights of the peaks at 829 $cm^{-1}$ and 697 $cm^{-1}$ are summed. The measurement is performed four times while the measurement position of the pellet is changed, and the four data are averaged.

Weight Average Molecular Weight (Mw) of Binder Resin

The weight average molecular weight is determined by gel permeation chromatography (GPC). The measuring method is as follows.

At first, the column is stabilized in a heat chamber at 40° C. The solvent (i.e., THF) is flown through the column at a speed of 1 ml/minute. On the other hand, a resin to be measured is dissolved in THF to prepare a THF solution of the resin having a resin content of from 0.05 to 0.6% by weight. Then 50 to 200 μl of the THF solution of the resin is injected to the column to obtain a GPC spectrum.

The molecular weight of the resin is determined while comparing the molecular distribution curve thereof with the working curve which is previously prepared using several polystyrene standard samples each having a single molecular weight peak. Specific examples of the polystyrene standard samples include standard polystyrenes which are manufactured by Pressure Chemical Co. or Tosoh Corporation and each of which has a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

It is preferable to prepare a working curve using at least ten standard polystyrenes. A RI (refractive index) detector is used as the detector.

Viscosity, Storage Modulus G' and Loss Modulus G"

One gram of a toner is pressed to prepare a pellet having a diameter of 25 mm and a thickness of 2 mm. The pellet is set in an instrument, DYNAMIC ANALYZER RDAII from Rheometric Co., to measure the above-mentioned rheology properties of the toner. In this case, a parallel plate with a diameter of 25 mm is used and sinusoidal vibration is applied while the temperature is changed. The measuring conditions are as follows:

Frequency: 1 Hz

Initial value of distortion: 10%

Temperature range: 60 to 200° C. (measurements are performed at intervals of 5° C.)

Copy Test

Each of the toners (T) was mixed with a copper-zinc ferrite carrier (C), which is coated with a silicone resin and which has an average particle diameter of 40 μm, in a ratio (T/C) of 5/95 by weight to prepare two component developers. The developers were evaluated using a copier, IMAGIO MF7070 manufactured and modified by Ricoh Co., Ltd. Copies of an original were produced at a rate of 5,000 copies per day, and 100,000 copies were produced in total. The evaluation items and evaluation methods are as follows:

(1) Agglomeration

The first and 100,000$^{th}$ images are observed to determine the number of agglomerated toner particles (which can be observed as black spots) present on the copy sheets.

(2) Amount of Agglomerated Toner Particles

After the 100,000-copy running test, the toner was sieved to determine the weight of toner particles remaining on the sieve, wherein the sieve is vibrated.

(3) Background Fouling

The 100,000$^{th}$ image is visually observed to determine whether the background area of the image is soiled with toner particles.

(4) Minimum Fixing Temperature

Toner images are fixed at different temperatures, and the images are rubbed with a cloth. Then the image density of the rubbed images is measured to determine the minimum fixing temperature.

(5) Maximum Fixing Temperature

Toner images are fixed at different temperatures, and the images are visually observed to determine whether the images have hot offset. The maximum fixing temperature of a toner is defined as a fixing temperature above which hot offset phenomenon occurs.

These properties are graded as follows:

◎: Excellent

○: Good

□: Acceptable

Δ: Bad

X: Very bad

The results are shown in Table 1.

TABLE 1

| | | Ex. 1 | Ex. 2 | Ex. 3 | Ex. 4 | Ex. 5 |
|---|---|---|---|---|---|---|
| Inorganic particle | Average particle diameter (nm) | 80 | 280 | 140 | 140 | 140 |
| | Coarse particle content (wt %) | 0.18 | 0.20 | 0.10 | 0.10 | 0.10 |
| | Added amount (parts by weight) | 0.3 | 0.3 | 0.3 | 1.0 | 1.0 |
| Binder resin | Content of components with Mw not higher than 1000 | 12 | 12 | 12 | 12 | 12 |
| Toner property | Fine particle content (% by quantity) | 12 | 12 | 12 | 12 | 8 |
| | Content of wax in surface portion (W/R) | 0.21 | 0.21 | 0.21 | 0.21 | 0.21 |
| | Viscosity (Pa · s) | 3600 | 3600 | 3600 | 3600 | 3600 |
| | G"/G' ratio | 4.2 | 4.2 | 4.2 | 4.2 | 4.2 |
| Copy test | Black spots | □ | ○ | ○ | ◎ | ◎ |
| | Amount of agglomerated toner | □ | □ | ○ | ○ | ○ |
| | Min. fixing temperature | ○ | □ | ○ | ○ | ○ |
| | Max. fixing temperature | □ | □ | □ | □ | □ |
| | Background fouling | □ | ○ | ○ | ○ | ◎ |

| | | Ex. 6 | Ex. 7 | Ex. 8 | Comp. Ex. 1 | Comp. Ex. 2 |
|---|---|---|---|---|---|---|
| Inorganic particle | Average particle diameter | 140 | 140 | 140 | 70 | 300 |

TABLE 1-continued

| | | | | | | |
|---|---|---|---|---|---|---|
| | (nm) | | | | | |
| | Coarse particle content (wt %) | 0.10 | 0.10 | 0.10 | 0.18 | 0.20 |
| | Added amount (parts by weight) | 1.0 | 1.0 | 1.0 | 0.3 | 0.3 |
| Binder resin | Content of components with Mw not higher than 1000 | 12 | 8 | 8 | 12 | 12 |
| Toner property | Fine particle content (% by quantity) | 8 | 8 | 8 | 12 | 12 |
| | Content of wax in surface portion (W/R) | 0.12 | 0.12 | 0.12 | 0.21 | 0.21 |
| | Viscosity (Pa · s) | 3600 | 3650 | 3400 | 3600 | 3600 |
| | G''/G' ratio | 4.2 | 4.3 | 3.8 | 4.2 | 4.2 |
| Copy test | Black spots | ◎ | ◎ | ◎ | Δ | ○ |
| | Amount of agglomerated toner | ◎ | ◎ | ◎ | Δ | ○ |
| | Min. fixing temperature | ○ | ○ | ◎ | ○ | Δ |
| | Max. fixing temperature | ○ | ◎ | ◎ | ○ | Δ |
| | Background fouling | ◎ | ◎ | ◎ | □ | ○ |

It is clear from Table 1 that the toners of Examples 1 to 8 (particularly, the toners of Examples 6 to 8) have good fixability and can produce high quality images without causing the agglomeration problem.

Example 9

Preparation of Polyester Resin D

The procedure for preparation of the polyester resin A in Example 1 was repeated except that the reaction time was changed to prepare a polyester resin D having a weight average molecular weight of 14,600, an acid value of 2.7 mgKOH/g and a glass transition temperature (Tg) of 63° C.

Preparation of Polyester Resin E

The procedure for preparation of the polyester resin D was repeated except that the tin (II) dioctanate was replaced with dibutyl tin (II) oxide, while the target glass transition temperature was changed. The resultant polyester resin E had a weight average molecular weight of 299,000, an acid value of 19.8 mgKOH/g and a glass transition temperature (Tg) of 70° C.

Preparation of Toner

The following components were mixed.

| | |
|---|---|
| Cyan pigment (PIGMENT BLUE 15-3, having a primary particle diameter of 90 nm) | 4 parts |
| Polyester resin D | 2.4 parts |
| Polyester resin E | 1.6 parts |
| Pure water | 2 parts |

The mixture was kneaded at 70° C. using a two roll mill. Then the temperature of the rollers was raised to 120° C. to evaporate water in the mixture. Thus, a colorant masterbatch was prepared.

The following components were mixed.

| | |
|---|---|
| The colorant masterbatch prepared above | 8 parts |
| Polyester resin D | 57.6 parts |
| Polyester resin E | 38.4 parts |
| Charge controlling agent (BONTRON E-84 from Orient Chemical Industries Co., Ltd.) | 2 parts |
| Carnauba wax | 5 parts |

The mixture was melted and kneaded for 40 minutes at 50° C. using a two-roll mill. After being cooled, the kneaded mixture was crushed with a hammer mill, followed by pulverizing with an air jet pulverizer and classification. Thus, a mother toner, which has a weight average particle diameter (D4) of 6.8 μm, was prepared.

Then the following components were mixed using a mixer to prepare a toner.

| | |
|---|---|
| Mother toner prepared above | 111 parts |
| Zinc stearate (from Sakai Chemical Industry Co., Ltd.) | 0.15 parts |
| Hydrophobized silica (from Clariant Japan) | 1 part |
| Hydrophobized titanium oxide (from Tayca Corp.) | 1 part |

Thus a toner of Example 9 was prepared.

Example 10

The procedure for preparation of the toner in Example 9 was repeated except that the polyester resin E was replaced with the following polyester resin F.

Polyester Resin F

The procedure for preparation of the polyester resin D was repeated except that the target glass transition temperature was changed. The resultant polyester resin F had a weight average molecular weight of 291,000, an acid value of 18.5 mgKOH/g and a glass transition temperature (Tg) of 69° C.

Thus a toner of Example 10 was prepared.

Comparative Example 3

The procedure for preparation of the toner in Example 9 was repeated except that the polyester resin D was replaced with the following polyester resin G.

Polyester Resin G

The procedure for preparation of the polyester resin D was repeated except that tin (II) dioctanate was replaced with dibutyl tin oxide and the target glass transition temperature was changed. The resultant polyester resin G had a weight average molecular weight of 14,000, an acid value of 2.7 mgKOH/g and a glass transition temperature (Tg) of 66° C.

Thus a toner of Comparative Example 3 was prepared.

The toners of Example 9 and 10 and Comparative Example 3 were evaluated as follows.

Weight Average Particle Diameter (D4)

The measuring method is mentioned above.

Weight Average Molecular Weight (Mw) of Binder Resin

The measuring method is mentioned above.

Copy Test

The procedure for the running test mentioned above was repeated.

The minimum and maximum fixing temperatures of each toner were evaluated in the same way as mentioned above.

The results are shown in Table 2.

TABLE 2

| | Fixing property of toner | |
|---|---|---|
| | Min. fixing temp. | Max. fixing temp. |
| Ex. 9 | ○ | ◎ |
| Ex. 10 | ◎ | ◎ |
| Comp. Ex. 3 | Δ | ◎ |

It is clear from Table 2 that the toners of Examples 9 and 10 have a good combination of low temperature fixability and hot offset resistance. In particular, when two kinds of polyester resins, each of which includes an inorganic tin (II) compound as a polymerization catalyst, are used as binder resins, the resultant toner (i.e., the toner of Example 10) has excellent combination of low temperature fixability and hot offset resistance.

When a combination of a first resin having a weight average molecular weight of from 5,000 to 50,000 and a second resin having a weight average molecular weight of from 200,000 to 400,000 is used as the binder resin, the resultant toner has good combination of low temperature fixability, hot offset resistance and high temperature preservability.

This document claims priority and contains subject matter related to Japanese Patent Applications Nos. 2004-077522 and 2004-077521, each filed on Mar. 18, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles comprising:

a binder resin comprising at least one polyester resin comprising an inorganic tin (II) compound having no Sn—C bond;

a wax having a melting point from 60 to 100° C.;

a colorant; and an external additive comprising a hydrophobized particulate inorganic material having a median diameter greater than 80 nm and less than 300 nm;

wherein an amount of the wax is in the toner is from 1 to 8 parts by weight per 100 parts by weight of the toner particles, a ratio (W/R) of a peak (W) of the wax observed in the vicinity of 3000 $cm^{-1}$ of a FTIR-ATR spectrum to a peak (R) of the binder resin in the vicinity of 830 $cm^{-1}$ is from 0.05 to 0.20, the at least one polyester resin was obtained by a reaction catalyzed by the inorganic tin (II) compound, and the inorganic tin (II) compound is selected from the group consisting of tin (II) carboxylates and tin (II) alkoxylates.

2. The toner according to claim 1, wherein an amount of coarse particles of the hydrophobized particulate inorganic material which does not pass through a sieve having openings of 45 μm is 0.16% or less by weight.

3. The toner according to claim 1, wherein an amount of the hydrophobized particulate inorganic material is from 0.4 to 4.0 parts by weight per 100 parts by weight of the toner.

4. The toner according to claim 1, wherein an amount of toner particles having a particle diameter equal to or less than 4 μm is 10% or less by quantity.

5. The toner according to claim 1, wherein the binder resin comprises a resin A having a weight average molecular weight of from 5,000 to 50,000 and a resin B having a weight average molecular weight of from 200,000 to 400,000, wherein the resin A is the at least one polyester resin comprising the inorganic tin (II) compound.

6. The toner according to claim 5, wherein the resin B is a polyester resin which comprises an inorganic tin (II) compound and the polyester resin B was obtained by a reaction catalyzed by the inorganic tin (II) compound.

7. The toner according to claim 5, wherein a content of the resin A is from 40 to 75% by weight based on total weight of the binder resin.

8. The toner according to claim 1, wherein an amount of tetrahydrofuran-soluble components having a weight average molecular weight not greater than 1,000 in the binder resin is from 0.5 to 10% by weight based on total weight of tetrahydrofuran-soluble components of the binder resin.

9. The toner according to claim 1, further comprising a lubricant.

10. The toner according to claim 9, wherein an amount of the lubricant is from 0.01 to 1.0 part by weight per 100 parts by weight of the toner particles.

11. The toner according to claim 1, wherein a viscosity of the toner is from 80 to 3500 Pa·s in a temperature range of from 130 to 180° C., and a ratio ($\tan\delta = G''/G'$) of loss modulus (G") to storage modulus (G') of from 1.0 to 4.0.

12. A developer comprising:

the toner according to claim 1; and a magnetic carrier.

13. The toner according to claim 1, wherein the tin(II) compound is selected from the group consisting of tin (II) oxalate, tin (II) diacetate, tin (II) dioctanate, tin (II) dilaurate, tin (II) distearate, tin (II) dioleate; dioctyloxy tin (II), dilauroxy tin (II), distearoxy tin (II), and dioleyloxy tin (II).

14. A toner comprising:

toner particles comprising:

a binder resin comprising a resin A having a weight average molecular weight of from 5,000 to 50,000 and a resin B having a weight average molecular weight of from 200,000 to 400,000, wherein the resin A comprises an inorganic tin (II) compound having no Sn—C bond;

a colorant; and an external additive comprising a hydrophobized particulate inorganic material having a median diameter greater than 80 nm and less than 300 nm;

wherein the polyester resin A was obtained by a reaction catalyzed by the inorganic tin (II) compound, and the inorganic tin (II) compound is selected from the group consisting of tin (II) carboxylates and tin (II) alkoxylates.

* * * * *